US005218166A

United States Patent [19]

Schumacher

[11] Patent Number: 5,218,166

[45] Date of Patent: Jun. 8, 1993

[54] MODIFIED NITROCELLULOSE BASED PROPELLANT COMPOSITION

[75] Inventor: John B. Schumacher, Huron, S. Dak.

[73] Assignee: MEI Corporation, Clearwater, Fla.

[21] Appl. No.: 763,266

[22] Filed: Sep. 20, 1991

[51] Int. Cl.[5] ..... F42B 5/18; C06B 21/00; C06B 45/10

[52] U.S. Cl. ..... 102/431; 149/19.2; 149/19.8; 149/19.92; 149/96; 149/109.6

[58] Field of Search ..... 149/19.2, 19.8, 19.92, 149/96, 109.6; 102/431

[56] References Cited

U.S. PATENT DOCUMENTS

| | | | |
|---|---|---|---|
| H778 | 5/1990 | Carlton et al. . | |
| 2,441,098 | 5/1948 | Hyde . | |
| 2,946,673 | 7/1960 | Grassle . | |
| 2,999,744 | 9/1961 | Eckels . | |
| 3,411,964 | 12/1968 | Douda . | |
| 3,453,156 | 7/1969 | Hackett et al. . | |
| 3,576,926 | 4/1971 | O'Mara . | |
| 3,622,655 | 11/1971 | Bonyata et al. . | |
| 3,639,160 | 2/1972 | Nelson | 427/226 |
| 3,665,862 | 5/1972 | Lane . | |
| 3,689,331 | 9/1972 | Pierce . | |
| 3,755,311 | 8/1973 | Zimmer-Galler | 149/19.2 |
| 3,779,820 | 12/1973 | Stevely et al. . | |
| 3,844,856 | 10/1974 | Flynn et al. . | |
| 3,917,767 | 11/1975 | Eich et al. | 179/100 |
| 3,923,564 | 12/1975 | Lantz | 149/19.8 |
| 3,928,230 | 12/1975 | Unsworth et al. . | |
| 3,960,621 | 6/1976 | Whitworth et al. . | |
| 3,963,545 | 6/1976 | Thomas et al. . | |
| 4,019,932 | 4/1977 | Schroeder . | |
| 4,060,435 | 11/1977 | Schroeder . | |
| 4,100,000 | 7/1978 | Sterling et al. . | |
| 4,214,927 | 7/1980 | Inoue et al. . | |
| 4,298,552 | 11/1981 | Gimler . | |
| 4,332,631 | 6/1982 | Herty et al. . | |
| 4,681,643 | 7/1987 | Colgate et al. . | |
| 4,701,228 | 10/1987 | Lagreze et al. . | |
| 4,711,815 | 12/1987 | Yoshiike et al. | 428/411.1 |
| 4,801,331 | 1/1989 | Murase | 252/364 |
| 4,814,274 | 3/1989 | Shioya et al. . | |
| 4,907,368 | 3/1990 | Mullay et al. . | |
| 4,911,770 | 3/1990 | Oliver et al. . | |

*Primary Examiner*—Edward A. Miller
*Attorney, Agent, or Firm*—Shlesinger Arkwright & Garvey

[57] ABSTRACT

The present invention relates to modified propellant compositions of either single or multiple based type which are obtained by resolvating a conventional, previously solvated nitrocellulose-based granular propellant with a solvent such as methyl ethyl ketone followed by the addition of glycerine to replasticize the composition and create a slurry. Upon evaporation of the solvent, a waterproof and self-supporting explosive composition is produced which is extremely stable and resistant to impact, friction and static discharge.

38 Claims, 1 Drawing Sheet

MODIFIED NITROCELLULOSE BASED PROPELLANT COMPOSITION

FIELD OF THE INVENTION

The present invention relates to single through multiple-base propellant composition, and more particularly to a nitrocellulose-based propellant composition which has been modified to yield a waterproof and caseless explosive charge and to a method of making such charges.

BACKGROUND OF THE INVENTION

Nitrocellulose-based propellant compositions are well known in the art, having wide ranging utility in the military, aerospace and civilian industries. For example, such propellant compositions are used as smokeless explosive charges for artillery and small arms, for solid fuel rocket engines and in blasting compositions employed within the construction industry.

Conventional granular, nitrocellulose-based propellant compositions generally contain nitrocotton (nitrocellulose), selected organic or inorganic salts for use as ballistic modifiers or stabilizers, and other additives such as carbon black. If other energetic bases such as nitroguanidine or nitroglycerine are also added, the propellant is termed a "multiple base" propellant. Thus, increasing the number of energetic bases within the propellant provides an effective means to enhance muzzle velocity of the charge and thereby increase shooting performance. Despite wide acceptance, conventional nitrocellulose-based propellants suffer from susceptibility to degradation if subjected to high humidity or water immersion. Conventional nitrocellulose-based propellants require careful storage and handling procedures in order to avoid accidental contact with moisture.

Prior art attempts have been made to waterproof conventional nitrocellulose-based propellants, however these have proven ineffective. Previous methods of waterproofing have concentrated on means to coat or encapsulate the individual propellant grains. This approach has resulted in either a reduction in performance of the explosive, an increase in residue and carcinogens upon ignition or less than favorable water resistance.

A further problem connected with conventional nitrocellulose-based propellants arises when attempting to produce a caseless charge from such propellants. Generally, a caseless charge must be designed so that, upon ignition, burning will not be limited to the surface of the charge but will occur throughout the cross-section of the charge as is found in conventional charges held by casings. In one prior art method, caseless cartridges have been made by compressing the individual propellant grains followed by solvent dipping or coating of the exterior of the cartridge to harden its surface. Cartridges produced by this method have been found to have suitable surface strength but lack overall strength and frequent breakages still occur. Further, this prior art method requires that the degree of compaction be sufficient to bind the individual grains so as to prevent breakage during normal handling yet not so great as to interfere with the friability of the individual grains thereby allowing each grain to burn separately and uniformly as if in a loose charge.

Another approach to the manufacture of caseless charges involves contacting the propellant grains with an aqueous solvating solution. Cartridges produced by this method are generally found to be too weak to withstand the normal handling required of ammunition. This is particularly true when such caseless charges are employed in bazookas, an armament requiring wafer-thin charges.

A still further problem associated with conventional nitrocellulose-based propellants is the limitation imposed upon such propellants when the various energetics chosen to be included within the propellant are antagonistic toward each other. For example, nitroglycerine, picric acid, nitroguanidine, cyclotetraethylenetetranitramine (HMX) and cyclotrimethylenetrinitramine (RDX) are all explosive compounds having varying performances, compatibilities, physical properties and sensitivities. Intermixing these various energetic compounds within a single multiple-base propellant does have limitations in that each of the components possess separate impact and interaction sensitivities. As a result, the potential liabilities of combining such highly volatile and explosive components often outweigh the inherent benefit of heightened shooting performance.

Prior art nitrocellulose based propellants also suffer from problems with respect to their temperature-dependent physical properties once they are molded into a caseless form. For example, a desired characteristic of a solid propellant is that it provide use over a fairly wide range of temperatures yet maintain its impetus. A solid propellant should also be flexible enough at lower temperatures to withstand rough handling and firing without fracturing of the grain structure. At elevated temperatures, the propellant must have sufficient firmness so that it will not melt, flow or migrate prior to use. These requirements are particularly apparent when considering the different physical environments into which such propellants are used; from arctic to jungle and desert locales.

Prior art nitrocellulose-based propellant compositions do not presently meet these temperature requirements and especially at lower temperatures. Attempts to remedy the problem have focused on increasing the amount of plasticizer within the propellant composition. Although such additions render the nitrocellulose-based propellant more flexible at low temperatures, there still exists an upper limit on the amount of plasticizer which can be incorporated. Beyond that point, the mixture tends not to cure into a solid. Further, excessive plasticizer has been known to separate within or otherwise externally bleed from the propellant thereby rendering the composition useless or even dangerous.

OBJECTS AND SUMMARY OF THE INVENTION

The present invention relates to modified propellant compositions of either single or multiple base type which are obtained by resolvating a conventional previously solvated nitrocellulose-based granular propellant with a solvent such as methyl ethyl ketone followed by the addition of glycerine to replasticize the composition and create a slurry. Upon evaporation of the solvent, a waterproof and self-supporting explosive composition is produced which is extremely stable and resistant to impact, friction and static discharge (ESD).

It is therefore an object of this invention to provide a nitrocellulose propellant which has a long shelf life and in which the sensitivity characteristics to shock, impact, friction and static discharge do not significantly change after long storage periods from that at time of original manufacture.

An additional object of the present invention is to provide a waterproof propellant which resists attack by salt water and humidity and thereby has both extended shelf and field life.

A further object is to provide a truly caseless charge and thus eliminate the need for paper and cloth containers.

It is an additional object of the present invention to provide a propellant composition which is clean burning, yields low residue upon detonation and cleans the bore of the armament when fired.

It is a further object of the present invention to provide a modified explosive propellant which can be shaped or formed into a wide variety of geometric configurations including for example, solid self-supporting monolith structures, flakes, beads or foamed structures having varying densities and dimensions.

Another object of the present invention is to provide a modified propellant structure in which the energetic components and plasticizers are migration-free, yielding a shaped propellant which will not crack when subjected to extreme temperatures or mishandling.

An additional object of the present invention is to provide a modified propellant composition which has the capability of wet storage and thus increased safety characteristics.

Still a further object of the present invention is to provide a modified propellant composition which finds utility for a wide variety of artillery and small arms as well as in the aerospace and construction industry including but not limited to caseless munitions, mines, rocket rodding, rocket motors, bag charges, deta-disc charges, mortar increments, head charges, underwater charges, cold bomb fill loading, flare gun charges, biodegradable mine charges, CAD/PAD for aircraft, plastic explosives and others.

Another object of the present invention is to provide a modified propellant composition which allows for the addition of ballistic modifiers, silicon and carbon-base polymers, catalysts, and other processing aids within the propellant during its production to yield an end product having a range of characteristics tailored to a specific use.

A further object of the present invention is to provide a modified propellant composition which, when formulated with a silicon based resin additive, yields particulate silicon dioxide gas upon firing that cleans the gun bore.

A still further object of the present invention is to provide an explosive propellant which may be inexpensively cast, extruded, foamed or rolled depending upon the formulation and the desired shape required of the end product.

It is another object of the present invention to provide an economical and comparatively safe process for the production of mass quantities of nitrocellulose-based propellant charges having incorporated therein highly energetic propellant ingredients with improved chemical compatibility and stability.

Still a further object of the present invention is to provide a propellant charge which can be modified by the addition of stabilizers, ballistic additives or other fuels dispersed within the slurry during processing to yield a cast propellant having a selected burn profile.

The manner in which these as well as other objects of the present invention can be accomplished will be apparent from the following detailed description and examples.

DETAILED DESCRIPTION OF THE PREFERRED EMBODIMENT

Figure 1:
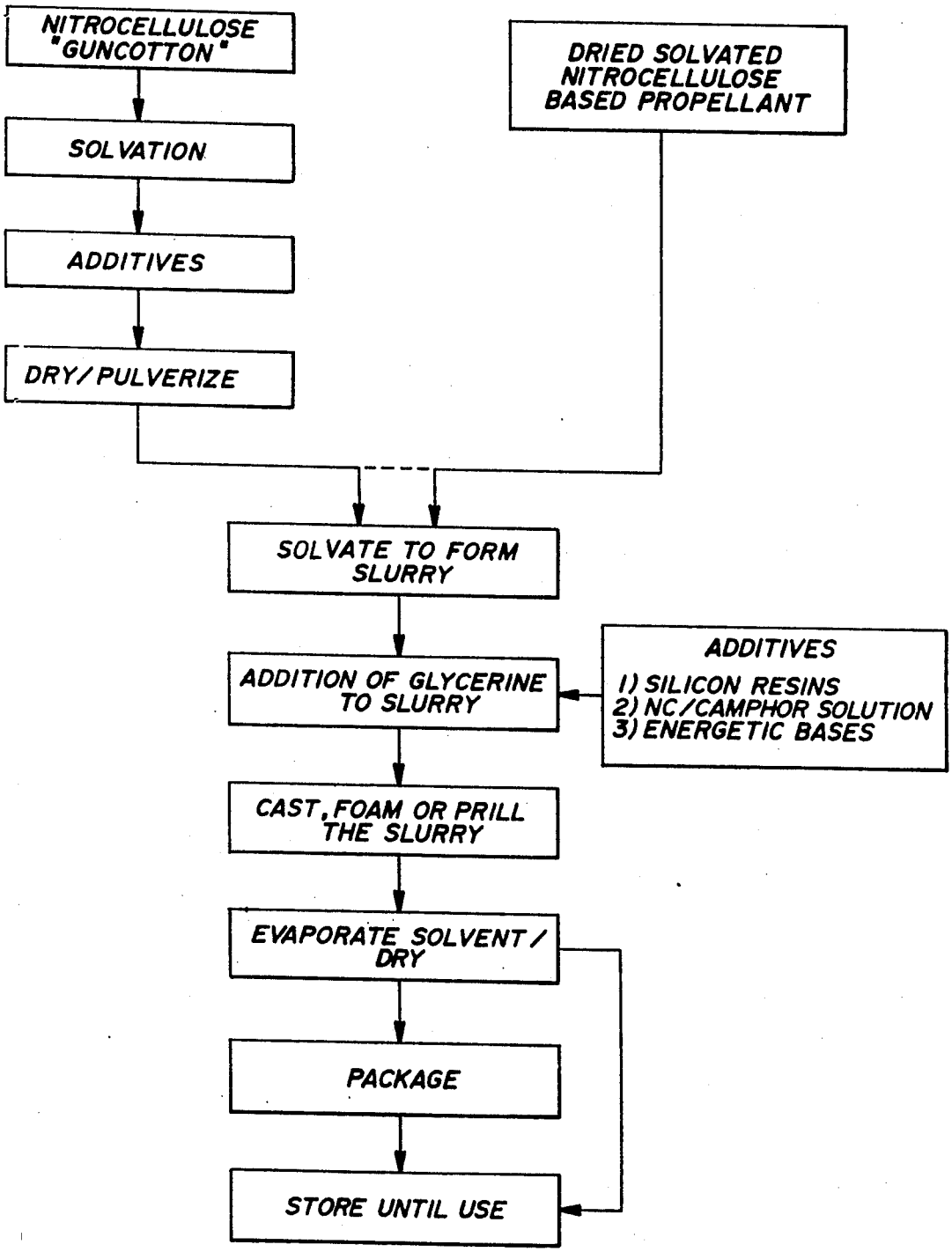
FIG. 1 illustrates a schematic diagram identifying the basic steps of the process according to the present invention.

The present invention is directed to the modification of a conventional nitrocellulose-based explosive propellant composition. Nitrocellulose-based compositions have long been available as smokeless gun powders and explosives. As used herein, the terminology "nitrocellulose-based composition" refers to any of the flaked or granular propellants which contain a high nitrogen nitrocellulose component possessing on average, a nitrogen content between about 13.2 to about 13.4 percent by weight. Nitrocellulose is a nitrated, polymerized cellobiose and if in the hexanitrated form, possesses superior explosive and flammable characteristics. As such, it is a well known component in the propellant industry and is often referred to as guncotton, pyroxylin or cellulose nitrate.

A single-base propellant will essentially contain "guncotton-type" nitrocellulose with minor additives. A double-base propellant will contain guncotton nitrocellulose as well as an additional nitroglycerine component. A triple-base propellant generally contains guncotton, nitroglycerine and nitroguanidine. A preferred double-base propellant according to the present invention is obtainable from Hercules Incorporated of Wilmington, Del. and is marketed and sold under the tradename Bullseye® Powder. Bullseye® powder has a 40% nitroglycerine content, 0.75% ethylene centralite (stabilizer), 1.25% potassium sulfate (anti-glare agent), 0.40% graphite glaze and the balance nitrocellulose, the nitrocellulose having a nitrogen content of about 13.2%.

In the alternative, the present invention contemplates the production of a conventional single-base, double-base or triple-base propellant powder prior to its modification according to the steps of the present method. Such production is well known in the art and set forth in U.S. Pat. No. 4, 701,228 and U.S. Pat. No. 3,622,655 which are incorporated herein by reference. The basic steps according those processes, is to first dissolve a dehydrated nitrocellulose in ether-alcohol or other solvent. After solvation, a selected number of ballistic additives, and if desired, nitrated oil and stabilizer are added. The resultant slurry is cast and then cured at an elevated temperature of about 43° C. to about 68° C. until a solid propellant mass is formed. The resultant dough, is then drawn and extruded into sheets, pulverized into the form of grains, filled into a mold, freed from liquid and dried to yield a conventional double-base explosive powder. Obviously, a single base or multiple base propellant can also be produced in a similar fashion and similarly find utility within the present invention.

After preparation of the solvated nitrocellulose-base propellant which has been dried and pulverized or otherwise obtaining a conventional, solvated, dried nitrocellulose-based propellant powder, the first step according to the present invention is to place the conventional propellant in a suitable mixer and resolvate it to yield a slurry having a paste-like consistency. Suitable solvents include methyl ethyl ketone, acetone, a 50-50 mixture of ether and acetone, isopropyl methyl ketone, diethyl ketone, propyl methyl ketone, isobutyl methyl ketone and mixtures thereof. Additional solvents are contemplated as being within the scope of the present invention so long as the selected solvent quickly saturates the nitrocellulose-based powder and allows rapid removal of residual solvent during the subsequent drying step. Methyl ethyl ketone is a preferred solvent in that it quickly saturates the nitrocellulose-based powder with less danger of ignition or flash fire.

After solvation, glycerine (1, 2, 3-propanetriol) is added to the slurry in an amount between about 0.5% to about 20% by weight of the mixture with a preferred amount between about 0.5% to about 9.0% by weight. The glycerine is extensively mixed within the slurry to provide uniform distribution and interaction with the solvated nitrocellulose. Although the amount of glycerine will vary with the type of nitrocellulose-based propellant to which it is added, too low an addition will yield an end product which is too brittle for practical use.

Subsequently, the solvent is removed from the slurry forming a dried solid. Solvent removal can be effected through the use of a conventional fume hood or other means known in the art, for example, the simultaneous application of heat and vacuum. The resultant dried end product is now a waterproof propellant which has retained the ballistic properties of the conventional nitrocellulose based propellant.

Although the exact mechanism is not fully understood, Applicant believes that the addition of the glycerine to the slurry after the previous solvation, replasticizes the nitrocellulose so as to "macroencapsulate" the explosive on a molecular level and thereby produce the heretofore unavailable waterproofing and highly stable caseless properties.

Optionally, the slurry may be conventionally cast into sheets, molded or extruded into a variety of caseless shapes and sizes prior to the solvent removal step. Any molding or extruding should be designed to substantially eliminate entrapment of air within the propellant via vacuum or other means. Drying rapidly removes the solvent. The sheets or formed shapes may be subsequently pulverized back into a powder form or in the alternative, the slurry may be "balled" or prilled prior to solvent removal to yield a free-flowing powder and as taught in U.S. Pat. No. 4,100,000 which is incorporated herein by reference.

A nitrocellulose/camphor solution having a nitrogen content extending between about 11.5% to about 12% may optionally be added to the slurry thereby adjusting the impetus of the end product propellant. A preferred solution according to the present invention contains 20% to about 25% solids, 1% plasticizer and 7 to 8% modifying resin. The plasticizers include the full range of conventional Department of Defense approved phthalates including but not limited to di-butyl phthalate, di-benzyl phthalate, tricresol phthalate, among others. Modifyinq resins encompass any of the conventional alkyds resins. These various ingredients are solvated in mixed systems using alcohols, ketones or esters. In some cases, the solvating systems may also contain hydrocarbons such as hexane. Since the end product formulation ideally contains no volatiles, physical or chemical effects upon ordnance performance caused by the aforementioned solvents is expected to be negligible.

If the above additives are part of the nitrocellulose solution, camphor is also included in the formulation. Camphor is a low volatility co-solvent for the nitrocellulose and is largely considered a reaction modifier because of its ability to catalyze the free radical decomposition mechanism of the nitrocellulose, thereby increasing combustion rates. Any perceived increase in sensitivity to ignition in a propellant composition containing a nitrocellulose/camphor solution is essentially mitigated within the present invention by the inclusion of the low concentrations of camphor.

A preferred nitrocellulose solution according to the present invention is obtainable from the Scholle Corporation of Northport, Ill. and contains 8% nitrocellulose/camphor solvated in acetone. The ratio of nitrocellulose to camphor is 8 parts to 2 parts respectively. The nitrogen content is 11.5%. Other sources of nitrocellulose/camphor solution are contemplated within the scope of the present invention so long as such nitrocellulose/camphor solutions comply with the basic requirements set forth above.

The preferred amount of nitrocellulose/camphor solution added to the solvated nitrocellulose propellant is generally within the range of about 2.0% to about 30% of the total weight. The preferred amount of camphor being about 0.07% to about 0.19% of the nitrocelulose/camphor solution. The amount added of nitrocellulose/camphor solution added to the solvated slurry varies depending upon the desired percent nitration of the end product. Since the amount of nitration is directly related to the explosive impetus of the end product propellant, the solution can, if so desired comprise upwards 30% by weight of the total composition. Applicant believes that the nitrocellulose/camphor solution functions to control the burn profile of the modified propellant since significant additions act to lower impetus.

In order to produce the waterproof, self-supporting propellant with specific characteristics in terms of density, flexibility and stiffness, additional plasticizers may be optionally added to the slurry prior to the solvent removal step. A preferred silicon-based polymer such as polysiloxane can be added to the slurry for such purposes. Silicon-base polymers are preferred in that they possess inherent physical and chemical properties which increase both the low temperature flexibility and the water resistance of the end product. Further, detonation of the modified propellant containing a polysiloxane resin results in a particulate silicon dioxide which has been found to be an effective abrasive cleaning agent for gun bores.

Exemplary of such silicon based polymers is Dow Corning 200 fluid ® (manufactured by Dow Corning Corporation, Midland, Mich.) which is widely available in the market and in a variety of viscosities. The present invention is not limited to Dow Corning 200 fluid ® but encompasses the full range of silicon type polymers known generally as polysilanes and characterized by having a polymer backbone of alternating silicone and oxygen atoms with pendent hydrocarbon groups on the silicone atoms. Such compositions are lightly cross-linked to form elastomeric materials. Some types are commonly known as room temperature curing silicon rubbers while others require the application of heat to enhance curing. The pendent hydrocarbon groups on the silicon atoms in such materials are predominately methyl groups but phenyl or vinyl groups are often included depending upon the desired utility of the end product.

Polysiloxanes are represented by the formula:

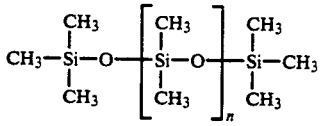

where n=200−300.

The polysiloxane resin is generally added after addition of the glycerine and in an amount between about 0.5% to about 10% of the total composition by weight with a preferred amount between about 0.5% to about 3.0% The polymer is preferably added to the mixer (operating at 3 rpm) at a rate of about 3.6 to 4.1 grams/-minute. A variety of viscosities are available, each having varying molecular weights. Thus, physical properties of the end products can be tailor-made to have specific flexibilities, tear strengths, hardness and densities depending upon the choice of the polymer properties of pendant group chemical identity, as well as both the degrees of polymerization and cross-linking. The present invention is not restricted to polysiloxane polymers but includes a variety of other silicon resin systems as well as carbon based resins including but not limited to thermosetting plastics, elastomers and rubbers and more specifically, the epoxies and polyester resins.

Residual traces of polymerizing agents used in the production of the guncotton component of the conventional, nitrocellulose-based propellant may result in grafting of a portion of the siloxane resin and glycerine plasticizers to the nitrocellulose backbone of the end product and increase its degree of polymerization. This mechanism may well contribute to the caseless and waterproof properties found in the end product propellant. Better control of end product properties may therefor be obtained by further addition to the slurry of polymerizing agents (drying agents) such as sulfuric acids.

The present invention further contemplates the optional addition of energetic bases, ballistic additives and modifiers and combustion catalysts to the slurry after addition of the glycerine but prior to removal of the solvent. The term "ballistic additive" refers to all components which are added to a propellant and affect either its combustion, in which case these additives are known as "combustion catalysts", or the flame or gas property, such as anti-stabilizing agents, energetic agents, or anti-glare agents, these latter additives being known as agents which do not catalyze the combustion.

The combustion catalysts usually employed in conventional double-base propellants and already known in the art are suitable for use as additives within the present invention. By way of example, combustion accelerators include acetylene black, lead salts and copper salts, such as lead oxides, copper oxides and lead or copper salicylates, octoates, stearates, and resorcylates. Combustion retarders according to the present invention include, for example, sucrose acetoisobutyrate (SAID) or sucrose octoacetate (SOA). Anti-glare agents which are suitable according to the present invention include potassium sulphate, potassium nitrate, potassium hydroge tartrate or potassium aluminum fluoride known commercially as cryolite. Stabilizers such as 2-nitrodiphenyl amine, diphenylamine, ethyl centralite or the like are also found to be within the scope of the present invention.

Ballistic modifiers and energetics include lead beta resorcylate, lead salicylate and the like; inorganic oxidizing agents such as picric acid and guanidine nitrate, diethyleneglycoldinitrate (DEGDN), cyclotrimethylene trinitramine (RDX), cyclotetramethylene tetranitramine (HMX) and fuels such as finely divided aluminum, beryllium, boron, and metal hydrides may also be added to the slurry prior to solvent drying. Conventional plasticizers include both the explosive and non-explosive type. Suitable explosive plasticizers include nitroglycerine, butane triol trinitrate, diglycol dinitrate, ethylene glycol dinitrate and the like. These explosive plasticizers can be mixed with one or more miscible, non-explosive type plasticizers such as triacetin, dibutyl phthalate, dimethyl sebacate, dibutyl adipate and the like.

The oxidizers, energetic bases and other noted additives if in liquid form or if mutually atagonistic, may be microencapsulated prior to addition to the slurry. U.S. Pat. No. 3,928,230 which is incorporated herein by reference discloses such microencapsulation techniques using barrier coatings between 1 to 500 microns in thickness. An additional option includes providing urethane or other foaming resins to the slurry to yield a variable density, cast propellant possessing the above noted waterproof and caseless properties, and which could be used to control the level of porosity.

The following examples further illustrate the process of this invention. All parts and percentages are by weight unless otherwise specified.

The Bullseye® powder used was a conventional double-base composition comprising 60% nitrocotton and 40% nitroglycerine, stabilized by the addition of 1% ethyl centralite which is used to coat the grains. The nitrogen content of the nitrocotton was 13.25%. This material was obtained from B. E. Hodgson of Shawnee-Mission Kan.. Bullseye® powder can also be purchased directly from its manufacturer, Hercules, Inc. of Wilmington, Del. as either a single-base, double-base, or triple-base composition. All these formulations are applicable to the present invention. The single-base compositions contain only nitrocotton as the explosive component, while the triple-base composition normally consists of nitrocotton, nitroglycerine, and nitroguanidine. Both the double and triple base compositions can also be obtained directly from the manufacturer if non-standard component ratios or compositions are desired. The Bullseye® powder is the unmodified nitrocellulose-based component in each of the formulations which follow. Formulation Nos. 1 through 6, of Table 1, indicate the amount of Bullseye® powder in grams with other components added as indicated. These additions were made either prior to, or immediately after, addition and solvation of the Bullseye® powder. Each of the formulations in Table 1 were normalized to 100 grams total batch size.

TABLE 1

| | Composition of Ordnance Propellant Test Formulations | | | | | | | | | | |
|---|---|---|---|---|---|---|---|---|---|---|---|
| FORMULATION | 1 | 2 | 3 | 4a | 4b | 4c | 4d | 5a | 5b | 6a | 6b |
| Bullseye ® | 50.00 | 48.90 | 47.17 | 49.75 | 49.50 | 47.60 | 45.45 | 48.78 | 47.73 | 48.66 | 46.62 |

TABLE 1-continued

| FORMULATION | Composition of Ordnance Propellant Test Formulations | | | | | | | | | | |
|---|---|---|---|---|---|---|---|---|---|---|---|
| | 1 | 2 | 3 | 4a | 4b | 4c | 4d | 5a | 5b | 6a | 6b |
| NC Solution | | 2.20 | 5.66 | | | | | 2.20 | 2.15 | 2.19 | 2.10 |
| Glycerine | | | | 0.50 | 1.00 | 4.80 | 9.10 | 0.24 | 2.39 | | |
| Dow 200 | | | | | | | | | | 0.49 | 4.66 |
| Solvent A | 50.00 | 48.90 | 47.17 | | | 47.60 | 45.45 | | | | |
| Solvent B | | | | 49.75 | 49.50 | | | | | | |
| Solvent C | | | | | | | | 48.78 | 47.73 | 48.66 | 46.62 |

Bullseye ® = Nitrocotton/nitroglycerine (60/40)
NC Solution = Nitrocellulose/camphor (80/20)
Dow 200 = Dow Corning Fluid 200 ®
Solvent A = Acetone
Solvent B = Ether/Acetone (50/50)
Solvent C = Methyl Ethyl Ketone Formulation No. 1 represents the simplest derivation, comprising 50 grams of Bullseye ® powder solvated in 50 grams of acetone. Formulation Nos. 2 and 3 comprise Bullseye ® powder in the indicated quantities of nitrocellulose solution, solubilized in the above noted acetone solvent. Formulation 4a through 4d are derivations of the basic formulation No. 1, with the addition of concentrations of the glycerine plasticizer. Formulation Nos. 5a and 5b are also derivations of the basic formula given in No. 1 and additionally containing the nitrocellulose solution and glycerine plasticizer. Formulation Nos. 6a and 6b substitute a polysilane plasticizer (Dow Corning 200 ® fluid) for the glycerine plasticizer given in Formulation 6a and 6b. The resultant end products of each of these formulations is given in Table 1. and each are further identified by their chemical make-up in Table 2. Table 3 indicates the ranges of each of the chemical constituents given in formulation Nos. 1 through 6 of Table 1.

TABLE 2

| FORMULATION | Chemical Composition of Ordnance Propellant End Products | | | | | | | | | | |
|---|---|---|---|---|---|---|---|---|---|---|---|
| | 1 | 2 | 3 | 4a | 4b | 4c | 4d | 5a | 5b | 6a | 6b |
| Nitrocotton | 60.00 | 59.78 | 59.43 | 59.40 | 58.81 | 54.50 | 50.00 | 59.49 | 56.95 | 59.19 | 54.37 |
| Nitroglycerine | 40.00 | 39.86 | 39.62 | 39.60 | 39.21 | 36.34 | 33.32 | 39.66 | 37.96 | 39.46 | 36.25 |
| Nitrocellulose | | 0.29 | 0.76 | | | | | 0.29 | 0.27 | 0.28 | 0.26 |
| Camphor | | 0.19 | 0.19 | | | | | 0.07 | 0.07 | 0.07 | 0.07 |
| Glycerine | | | | 1.00 | 1.98 | 9.16 | 16.68 | 0.49 | 4.75 | | |
| Polysilane | | | | | | | | | | 1.00 | 9.06 |

TABLE 3

| Substituent | Concentration Ranges for Each Chemical Substituent | |
|---|---|---|
| | Minimum Concentration (%) | Maximum Concentration (%) |
| Nitrocotton | 50.00 | 60.0 |
| Nitroglycerine | 33.30 | 40.0 |
| Nitrocellulose | 0.00 | 0.76 |
| Camphor | 0.00 | 0.19 |
| Plasticizers: | | |
| Glycerine | 0.00 | 16.68 |
| Polysilane | 0.00 | 9.06 |

Turning now to Table 4, the above formulation Nos. 1 through 6 of Table 1 as well as a conventional, nonmodified, double-base propellant (Bullseye ® powder) are listed for comparative sensitivity testing. The sensitivity testing was conducted by Research and Development personnel at the Longhorn Facilities of Morton-Thiokol.

TABLE 4

| Sample | Ordnance Propellant Sensitivity Test Results | | | |
|---|---|---|---|---|
| | Volatiles (%) | Sensitivity | | |
| | | Impact (in) | Friction (lbf) | ESD (joules) |
| Bullseye ® (std) | 0.54 | 4 | 70 | 2.25 |
| 1 | 1.77 | 2 | 65 | 1.32 |
| 2 | 1.57 | 5 | 55 | 1.21 |
| 3 | 1.36 | 5 | 40 | 1.56 |
| 4a | 3.95 | 5 | 40 | 3.80 |
| 4b | 1.89 | 4 | 70 | 3.06 |
| 4c | 3.11 | 4 | 70 | 1.10 |
| 4d | 3.73 | 6 | 70 | 1.21 |
| 5a | 2.33 | 7 | 40 | 2.72 |
| 5b | 13.89 | 6 | 70 | 2.56 |
| 6a | 0.97 | 5 | 70 | 2.25 |
| 6b | 8.44 | 6 | 70 | 1.56 |

TABLE 5

| Sample | Ordnance Propellant Energetics Test Results | | |
|---|---|---|---|
| | Volatiles (%) | Measured Impetus (Im) (ft-lb/lb) | Normalized[1] Impetus (Im) (ft-lb/lb) |
| Bullseye ® (std) | 0.54 | 287,000 | |
| 1 | 1.77 | 261,000 | 261,000 |
| 2 | 1.57 | 240,000 | 237,000 |
| 3 | 1.36 | 241,000 | 234,000 |
| 4a | 3.95 | 288,000 | 251,000 |
| 4b | 1.89 | 243,000 | 245,000 |
| 4c | 3.11 | 200,000 | 216,000 |
| 4d | 3.73 | 143,000 | 164,000 |
| 5a | 2.33 | 211,000 | 219,000 |
| 5b* | 13.89 | 197,000 | |
| 6a | 0.97 | 245,000 | 288,000 |
| 6b* | 8.44 | 212,000 | |

[1]Values of Impetus normalized to % Volatiles of Sample No. 1. The empirically derived normalization equation used:
$I_n = 21\,000 \times [(V_i - V_1)/V^1_i] + I_m$ where:
$I_m$ is the measured Impulse
$I_n$ is the normalized Impulse
$V_i$ is the % Volatiles of the $i^{th}$ sample
and, $V_1$ is the % Volatiles of Sample No. 1
*Samples have % Volatiles outside range of validity of the empirically derived normalization equation. No attempt was made to normalize these measured Impulses.

TABLE 6

One Year Aged Sample Stability and Energetics Test Results For Subject Ordnance Propellants

| Aged Sample | Volatiles (%) | Sensitivity Impact (in) | Friction (lbf) | ESD (Joules) | Impetus (ft-lb/lb) |
|---|---|---|---|---|---|
| Bullseye ® | 0.54 | 4 | 70 | 2.25 | 287 000 |
| 1 | 0.93 | 7 | 55. | 2.56 | 226 000 |
| 2 | 0.62 | 10 | 65 | 2.53 | 221 000 |
| 3 | 0.39 | 6 | 55 | 2.41 | 225 000 |
| 4 | 0.43 | 5 | 55 | 2.56 | 225 000 |
| 5 | 0.50 | 8 | 70 | 2.37 | 243 000 |
| 6 | 0.46 | 5 | 70 | 2.56 | 249 000 |
| Average[1] | 0.49 | 6.8 | 61.7 | 2.50 | 231 500 |
| Std. Dev[1] | 0.07 | 1.8 | 6.9 | 0.08 | 10 500 |

[1]Average and standard deviation calculated using aged samples numbered 1-6 only.

Sample No. 1 given in Table 4 corresponds to the formulation given in Table 1 and is the standard double-base propellant known as Bullseye ® powder solvated in acetone alone. For all of these samples, the prepared slurries were spread out in sheet form on standard Velostat ® film followed by solvent removal via air evaporation at ambient temperature and pressure. The formulated end products were then cut and analyzed for percent volatile, sensitivity and energetics. Testing was done in accordance with the Department of Defense specifications for sensitivity to impact, friction, electrostatic discharge and energetics measured as impetus.

Sensitivity to impact is defined as the minimum distance a standard weight must fall in order to cause detonation of the sample. The impact is measured in units of inches. Sensitivity to friction is defined as the minimum applied pressure required for a standard surface, moving at a constant velocity across the sample surface, to cause detonation. The units of measurement of this quantity are LBF (pounds force). The sensitivity to static discharge, or EST is a measure of the minimal amount of static charge transferred to the sample required to cause detonation. The unit of measurement of this quantity is Joules. Joules is an energy unit and is related to the amount of static discharge delivered to the sample as a function of time. The energetics of a sample are measured as the impulse, or the amount of energy, in foot-pounds, obtained per pound of detonated sample. The results of all these tests for the formulations listed in Table 1 is given in Tables 4 and 5. Table 6 gives the same results for several samples aged for one year under ambient conditions. Average values for each measured quantity are also included in Table 6. In all three tables, the results obtained for the formulations according to the present invention are compared to test results for a standard, unmodified nitrocellulose-based explosive, in this instance Bullseye ® powder.

Several important observations can be made by comparison of the results reported in Tables 4 and 6. Much larger variance is observed in all sensitivity measurements for fresh samples and aged samples. Although the percent volatiles of the aged samples is on average, four times lower than that of freshly made samples, no clear correlation is observed for volatile content of the fresh samples and the observed fluctuations of the sensitivity data.

Formulation Nos. 4a through 4d however, indicate that an increase in sensitivity to static discharge (ESD) is observed with increasing levels of plasticizer. This observation is supported by the results of both formulations 5a and 5b, which contain both the nitrocellulose/-camphor and the two levels of glycerine plasticizer. The ESD results compare favorably with those reported for the unmodified Bullseye ® powder.

Formulation Nos. 1 through 3 of Table 4 indicate that ESD sensitivity increases by a factor of two over the value for unmodified Bullseye ® powder. However, formulation No. 1 is simply conventional Bullseye ® powder solvated in acetone and cast into sheets. No additives according to the present invention are used in formulation No. 1. The volatiles present are more than three times larger for formulation No. 1 than for unmodified Bullseye ® powder. Formulations 2 and 3, which contain two levels of nitrocellulose/camphor and no plasticizer compare favorably with formulation No. 1 thereby indicating that the presence of these materials in the formulation will not seriously affect the ESD sensitivity of the end product. Thus, the ESD sensitivity values reported for formulation Nos. 5a, 5d, 6a and 6b appear to be independent of the nitrocellulose and camphor in these samples.

From the foregoing, the following observations on the ESD sensitivity of the end product formulations according to the present invention can be made. The ESD sensitivity of the invention appears independent of the level of nitrocellulose and camphor over the range of interest. The ESD sensitivity correlates to the amount of plasticizer used, increasing with the level of added plasticizer. It should be noted, however, that the end product formulations of the present invention are, as a class, favorably comparable with values obtained for the unmodified Bullseye ® and that formulation No. 5a, which most closely represents the aged sample formulation, has an ESD sensitivity value only slightly larger than the average value of the aged samples.

In general, all formulations have a friction sensitivity value approximating that of unmodified Bullseye ® powder. Friction sensitivity, however, does appear most closely correlated with the level of nitrocellulose/camphor used in the formulation. Formulation Nos. 1 through 3, show increasing sensitivity to friction with increasing levels of that component. Plasticizer levels above 1.0% in the end product (see Table 2) (glycerine and polysilane) result in a friction sensitivity decreasing rapidly to that of unmodified Bullseye ® powder.

In summary, although friction sensitivity increases with nitrocellulose/camphor content, the addition of a plasticizer in levels greater than 1.0% mitigates that effect and gives values for the end products comparable to that of the unmodified Bullseye ® powder. The aged samples which are most closely approximated by fresh formulation No. 5a given in Table 4, have glycerine contents ranging from between about 1 to about 2%. The friction sensitivity values reported in Table 6 correlate well with the observations made from Table 4 of the fresh sample formulations.

Impact sensitivity for all of the formulations given in Tables 4 and 6 generally tend to be well above those as compared with unmodified Bullseye ® powder. Formulations containing higher levels of plasticizer also demonstrate a tendency to be less sensitive to impact thereby demonstrating larger values for impact sensitivity. Formulations containing nitrocellulose/camphor also show a decrease in sensitivity with increasing levels of that additive and those containing plasticizer demonstrate the lowest sensitivity to impact. Applicant believes that the decrease in impact sensitivity through the addition of plasticizers may well be related to the decreasing hardness of the end product formulations, which would provide for larger impact resistance by increasing the tendency to distribute the impact force throughout the sample volume.

The energetics for the end product formulations given in Tables 2 are listed in Table 5 as impetus. A strong correlation between percent volatile and measured impetus is clearly seen with any residual solvent resulting in a non-linear dampening of the detonation. An empirical equation was derived to normalize the measured impetus values. In Table 5, the measured values are indicated by $I_m$ with normalized values given by $I_n$. The values were normalized to the Impetus of formulation No. 1 which is standard Bullseye® powder in a solvent. Further normalization of the linearized impetus data to that of unmodified Bullseye® powder demonstrates good agreement between the impetus of formulation No. 1 and that for unmodified Bullseye® powder (See Formulation No. 1: 292,000; standard Bullseye® powder: 287,000). This normalization was done to facilitate comparison of the impetus values given in Table 5 to the various samples after accounting for solvent effects.

It can be seen from the data that increasing plasticizer levels result in a linear decrease of impetus. Since the plasticizer is an inert component, this effect is to be expected because the added plasticizer acts as a diluent.

Comparing the normalized impetus ($I_n$) values for formulation Nos. 1, 2 and 3, this quantity is observed to decrease with increasing nitrocellulose content. The effect additions of nitrocellulose/camphor have upon impetus is less clearly understood since small quantities of that component result in a significant decrease in impetus, but with increasing concentrations the impetus becomes relatively constant. As noted earlier, Applicant adds nitrocellulose/camphor to modify the burn profile of the end product propellant since significant additions act to somewhat lower impetus.

Comparison of the impetus values for the aged samples given in Table 6 against those of Table 5 also indicate good agreement between aged and fresh samples, especially after accounting for the percent volatile difference. Since formulation Nos. 5a of Table 5 most closely approximates the formulation in Table 6, further normalization of the impetus of this sample to the average volatiles given in Table 6 also compare well (Formulation 5a: 246,000; average impetus: 231,500). It is clear from this evaluation that the impetus values obtained for the present invention fully agree with those of unmodified Bullseye® powder. It is further apparent from the above evaluation that several properties of the invention, most notably the impact sensitivities of the present invention show significant improvement over those for unmodified Bullseye® powder.

In summary, the present invention compares favorably both in sensitivities and energetics to systems presently employed which currently use unmodified Bullseye® powder as the detonatable component. However, the formulations according to the present invention further contain the extremely beneficial characteristics of being self-supporting and caseless as well as waterproof while giving up none of the desired properties found in unmodified Bullseye® Powder propellant. In addition, cast products according to the present invention have been observed to be extremely flexible and show excellent shelf life as demonstrated by the results reported in Table 6.

EXAMPLE 1

Approximately 450 grams of methyl ethyl ketone (MEK) were poured into a one gallon polyethylene jar. 450 grams of a double-base Bullseye® powder were then added to the solvent. To this mix, an addition was made of 20.3 grams of 8% nitrocellulose/camphor in acetone and 2.2 grams glycerine. Although the Bullseye® powder is insoluble in the ketone, the nitrocotton component appeared to absorb the ketone, resulting in swelling of the nitrocotton and ensuring both transport and absorption within the nitrocotton/MEK dispersion of nitroglycerine, nitrocellulose/camphor and glycerine components. The jar was tightly sealed and placed on a bottle roller to ensure the uniform distribution of the components.

The viscous slurry was poured onto a velostat® sheet, and placed under a fume hood for 16 hours to evaporate the methyl ethyl ketone. After drying, the samples were removed from the velostat® sheet.

EXAMPLE 2

Approximately 450 grams of methyl ethyl ketone (MEK) were poured into a one gallon polyethylene jar. To the solvent, 4.53 grams of Dow Corning silicon fluid 200® were then added. The viscosity of this polysilane resin was 100,000 centistokes. Because of the high viscosity, the jar was sealed and placed in a bottle roller for 15 minutes to ensure uniform distribution of the polysilane resin.

The jar was then removed from the bottle roller, and additions were made of 450 grams of Bullseye® powder, 20.25 grams of the 8% nitrocellulose/camphor solution and 2.2 grams glycerine. The jar was again tightly sealed and replaced on the bottle roller for an additional hour.

The viscous slurry was spread out on a velostat® sheet and placed under a fume hood for 16 hours to evaporate the methyl ethyl ketone. After drying, the samples were removed from the sheet.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

I claim:

1. A method for producing a waterproof and caseless nitrocellulose-based propellant comprising:
   a) providing a dried high nitrogen content previously solvated nitrocellulose based propellant;
   b) resolvating the solvated nitrocellulose-based propellant with a solvent to form a slurry;
   c) adding glycerine to the resolvated nitrocellulose based propellant slurry; and,
   d) recovering the solvent from the slurry to dry the same and thus produce the waterproof and caseless nitrocellulose-based propellant.
2. The product by the process of claim 1.
3. The method of claim 1, and wherein:
   a) the glycerine is added in an amount between about 0.5% to about 20% by weight of the slurry.
4. The method of claim 1, and wherein:

a) the nitrocellulose-based propellant is a single or double or triple base propellant selected from the group consisting of nitrocellulose, nitrocellulose in combination with nitroglycerine and nitrocellulose in combination with glycerine and nitroguanidine.

5. The method of claim 1, and wherein:
a) the solvent is selected from the group consisting of methyl ethyl ketone, acetone, a fifty/fifty mixture of ether and acetone, isopropyl methyl ketone, diethyl ketone, propyl methyl ketone, isobutyl methyl ketone and mixtures thereof.

6. The method of claim 1, and wherein:
a) removing the solvent from the slurry through the application of heat and vacuum.

7. The method of claim 1, including the step of:
a) adding a nitrocellulose/camphor solution to the slurry in an amount between about 2.0% to about 30% by weight of the slurry.

8. The method of claim 1, including the steps of:
a) adding a silicon resin to the slurry; and,
b) curing the silicon resin.

9. The method of claim 8, and wherein:
a) said silicon resin is represented by the formula:

$$(CH_3)_3\,SiO—[Si(CH_3)_2O]_n—Si(CH_3)_3$$

where n=200-350.

10. The method of claim 8, and wherein:
a) the silicon resin is added to the slurry in an amount between about 0.5% to about 10% by weight of the slurry.

11. The method of claim 1, including the steps of:
a) casting the slurry into a selected shape prior to drying; and,
b) recovering a caseless propellant.

12. The method of claim 1, including the step of:
a) foaming the slurry prior to drying; and,
b) curing the foamed slurry.

13. The method of claim 1, including the step of:
a) prilling the slurry prior to drying; and,
b) recovering a free-flowing propellant powder.

14. The method of claim 1, including the step of:
a) adding to the slurry prior to drying an energetic base selected from the group consisting of nitroglycerine, picric acid, nitroguanidine, 1, 2, 4-benzenetriamine dihydrochloride, cyclonite, diethylene glycodinitrate, dithiooxamide, pyrazole, benzotriazole, p-nitrophenylhydrazine, oxalyl dihydrazide, nitrobenzylazide, 3-nitrophthalamide, cellulose nitrate, 2, 4dinitrophenylhydrazine, cyclotetraethylenetetranitramine, cyclotrimethylenetrinitramine, butane triol trinitrate and diglycol dinitrate.

15. The method of claim 14, and wherein:
a) microencapsulating the selected energetic bases prior to addition to the slurry.

16. The method of claim 1, and wherein:
a) the nitrocellulose based propellant has a nitrogen content between about 12.4% to about 13.4%.

17. The method of claim 11 including the step of:
a) pulverizing the shaped and dried propellant into a powder.

18. The method of claim 17, including the step of:
a) filling a casing with the powder to provide a selected explosive charge.

19. The method of claim 13, including the step of:
a) filling a casing with the prilled powder to provide a selected explosive charge.

20. A method for producing a waterproof and caseless nitrocellulose-based propellant comprising:
a) providing a high nitrogen content dehydrated nitrocellulose guncotton;
b) solvating the nitrocellulose guncotton in a solvent to form a first slurry;
c) adding selected energetic bases to the first slurry;
d) casting and curing the first slurry into sheets;
e) pulverizing the cured sheets into a dried powder;
f) resolvating the dried powder to form a second slurry;
g) adding glycerine to the second slurry; and,
h) recovering the solvent from the second slurry to dry the same and thus produce the waterproof and caseless nitrocellulose-based propellant.

21. The product by the process of claim 20.

22. The method of claim 20, wherein:
a) the glycerine is added in an amount between about 0.5% to about 20% by weight of the second slurry.

23. The method of claim 20, and wherein:
a) the dried powder is a nitrocellulose-based propellant of a single or double or triple base type and is selected from the group consisting of nitrocellulose, nitrocellulose in combination with nitroglycerine and nitrocellulose in combination with glycerine and nitroguanidine.

24. The method of claim 20, and wherein:
a) resolvating the dried powder to form a second slurry with a solvent selective from the group consisting of methyl ethyl ketone, acetone, a fifty fifty mixture of ether and acetone, isopropyl methyl ketone, diethyl ketone, propyl methyl ketone, isobutyl methyl ketone and mixtures thereof.

25. The method of claim 20, and wherein:
a) recovering the solvent from the second slurry by the application of heat and vacuum.

26. The method of claim 20, including the step of:
a) adding a nitrocellulose/camphor solution to the second slurry in an amount between about 2.0% to about 30% by weight of the second slurry.

27. The method of claim 20, including the steps of:
a) adding a silicon resin to the second slurry; and,
b) curing the silicon resin.

28. The method of claim 27, and wherein:
a) said silicon resin is represented by the formula:

$$(CH_3)_3\,SiO—[Si(CH_3)_2O]_n—Si(CH_3)_3$$

where n=200−350.

29. The method of claim 27, and wherein:
a) the silicon resin is added to the second slurry in an amount between about 0.5% to about 10% by weight of the second slurry.

30. The method of claim 20, including the steps of:
a) casting the second slurry into a selected shape prior drying; and,
b) recovering a caseless propellant.

31. The method of claim 20, including the steps of:
a) foaming the second slurry prior to drying; and,
b) curing the foamed slurry.

32. The method of claim 20, including the steps of:
a) prilling the second slurry prior to drying; and,
b) recovering a free-flowing propellant powder.

33. The method of claim 20, including the step of:
a) adding to the second slurry prior to drying an energetic base selective from the group consisting of nitroglycerine, picric acid, nitroguanidine, 1, 2, 4-benzenetriamine dihydrochloride, cyclonite, diethylene glycodinitrate, dithiooxamide, pyrazole, benzotriazole, p-nitrophenylhydrazine, oxalyl dihydrazide, nitrobenzylazide, 3-nitrophthalamide, cellulose nitrate, 2, 4-dinitrophenylhydrazine, cyclotetraethylenetetranitramine, cyclotrimethylenetrinitramine, butane triol trinitrate and diglycol dinitrate.

34. The method of claim 33, and wherein:

a) microencapsulating the selected energetic basis prior to addition to the second slurry.

35. The method of claim 20, and wherein:

a) the guncotton as a nitrogen content between about 12.4% to about 13.4%.

36. The method of claim 30 including the step of:

a) pulverizing the shape and dried propellant into a powder.

37. The method of claim 36, including the step of:

a) filling a casing with the power to provide a selected explosive charge.

38. The method of claim 32, including the step of:

a) filling a casing with the prilled powder to provide a selected explosive charge.

* * * * *